US009538857B2

(12) United States Patent
Klancnik

(10) Patent No.: US 9,538,857 B2
(45) Date of Patent: Jan. 10, 2017

(54) FIRE-RESISTANT MATTRESS HAVING COMBUSTIBLE MATERIAL COMPARTMENTALIZED BETWEEN FIRE-RESISTANT LAYERS

(71) Applicant: Serta, Inc., Hoffman Estates, IL (US)

(72) Inventor: Alvin R. Klancnik, South Barrington, IL (US)

(73) Assignee: SERTA, INC., Hoffman Estates, IL (US)

( * ) Notice: Subject to any disclaimer, the term of this patent is extended or adjusted under 35 U.S.C. 154(b) by 897 days.

(21) Appl. No.: 13/734,782

(22) Filed: Jan. 4, 2013

(65) Prior Publication Data

US 2013/0133139 A1 May 30, 2013

Related U.S. Application Data

(63) Continuation of application No. 13/198,631, filed on Aug. 4, 2011, now abandoned, which is a continuation of application No. 10/934,971, filed on Sep. 3, 2004, now abandoned.

(51) Int. Cl.
*A47C 31/00* (2006.01)

(52) U.S. Cl.
CPC ..... *A47C 31/001* (2013.01)

(58) Field of Classification Search
CPC ..... A47C 31/00
USPC ..... 5/690, 698, 954, 740
See application file for complete search history.

(56) References Cited

U.S. PATENT DOCUMENTS 3,512,192 A * 5/1970 Simon ..... 5/698
7,150,059 B2 * 12/2006 Small et al. ..... 5/698

* cited by examiner

*Primary Examiner* — Fredrick Conley
(74) *Attorney, Agent, or Firm* — Cantor Colburn LLP

(57) ABSTRACT

A mattress is disclosed that includes a sleeping side, a cushioning layer, an inner support compartment, and a fire-containing compartment disposed between the sleeping side and the inner support compartment. The fire-containing compartment includes first and second layers of fire-resistant material selected from the group consisting of a barrier sheet, a high loft batt, and a fire-resistant chemical. The cushioning layer is disposed between the first and second layers of fire-resistant material.

20 Claims, 6 Drawing Sheets

FIRE-RESISTANT MATTRESS HAVING COMBUSTIBLE MATERIAL COMPARTMENTALIZED BETWEEN FIRE-RESISTANT LAYERS

CROSS-REFERENCE TO RELATED APPLICATIONS

This application is a continuation of U.S. application Ser. No. 13/198,631, filed Aug. 4, 2011, which is a continuation of U.S. application Ser. No. 10/934,971, filed Sep. 3, 2004 (now abandoned), each of which is incorporated by reference.

FIELD OF THE INVENTION

This invention pertains to mattresses and, in particular, to a fire-retardant mattress and a method for manufacturing the same.

BACKGROUND OF THE INVENTION

Since at least the late 1960s, mattress manufacturers have been concerned with fires in mattresses that have been associated with bedroom fires. During this time, some 30,000 bedroom fires were attributed to mattresses as most of the fires were determined to be caused by cigarette ignition of the mattress resulting from people smoking in bed. An additional 22,000 fires were attributed to open flame ignition of the mattress. Given the large number of fires attributed to cigarette smoking, federal standards were introduced in an attempt to limit the spread of fires that originated on a mattress.

In the late 1980s, open flame ignition surpassed cigarette ignition as the main cause of mattress fires. Later it was determined, through several studies, that the primary source of bedroom fires was the burning of bedclothes located on top of the mattress. Furthermore, it was found that the majority of these fires were caused by children playing with ignition sources such as lighters, matches and candles which then ignited the top-of-the-bed accessories such as sheets, blankets and pillows.

As a result of these surveys, studies were conducted to improve the understanding of mattress fires. These studies led to the development of a test apparatus that could accurately and consistently simulate the burning bedclothes ignition source.

The tests involved placing a mattress/foundation on top of a steel twin-sized bed frame which, in turn, rested on a cement fiberboard surface that formed the bottom of a catch pan. A pair of gas burners was designed to mimic the thermal impact of burning bedclothes. One burner was placed so as to impinge on the top of a mattress surface while the second impinges nearby on the mattress side. The flame generated by the side burner was allowed to burn for 50 seconds while the flame from the top burner burned for 70 seconds. The fires generated by these burners were monitored and it was observed that a typical mattress reached flash-over value in approximately three minutes.

As a result of these studies, California established a regulation (Technical Bulletin 603) that required that a fire on a mattress could not exceed 25 mega joules of heat in the first 10 minutes of the fire, or a peak rate of heat release of 200 kW over a 30-minute period. A problem associated with reaching this criterion is that it is difficult to place a fire-retardant barrier on the outside of the mattress as the treatment that allows a barrier to be fire retardant makes the mattress surface hard and uncomfortable to the touch. For this reason, the outer layer of a mattress is typically some type of quilt or ticking material that burns fairly easily and is considered sacrificial material.

In residential bedroom fires, three different types of people are at risk from the fire. The first of these is the person in the room in which the fire originates and is intimate with the fire. This person would normally be someone on the mattress. The second person is in the room in which the fire originates, but is not intimate with the fire. This could be someone sitting in a chair in the bedroom in which the mattress catches fire or a child who started the fire and is hiding behind a dresser. The third person is someone who is not in the room in which the fire originates and is also not intimate with the fire. This would include someone located in another room in the house in which the mattress catches fire.

The regulation promulgated in Technical Bulletin 603 provides a valuable 30-minute window for the people at risk to detect and escape a fire. Furthermore, the low-peak-heat-release limit will substantially delay the growth and intensity of a fire. Combined, these requirements significantly reduce the risk of rapid flashover to other parts of the residence and thus substantially expand the opportunity for consumers to escape a bedroom fire.

By reducing the size and growth rate of a fire, it is possible to reduce bed fire casualties by one-half to two-thirds. This is because extra time to escape the residence is provided, particularly for those individuals who are not intimate with the fire. Furthermore, additional time is also provided for a person on the mattress to escape with only isolated burns, if any.

In practice, mattress manufacturers follow either or both of two approaches to fire risk reduction: (a) reduce the likelihood of sustained ignition and (b) mitigate the consequences of an ignition. To help achieve these goals, typical fire-resistant mattresses have a fire-resistant barrier located near the outer layer of the mattress, with the outer layer being made of a quilt or ticking material. This fire-resistant barrier works most of the time; however, should the barrier fail, there is no way of preventing the fire from spreading rapidly through the mattress to the inner support compartment, thereby causing a flashover and engulfing the entire mattress in flames. For this reason, the ability to slow the spread of fire that has breached the first fire-resistant barrier would be an important improvement in the art.

BRIEF SUMMARY OF THE INVENTION

In one aspect, a mattress includes a sleeping side, a cushioning layer, an inner support compartment, and a fire-containing compartment disposed between the sleeping side and the inner support compartment. The fire-containing compartment includes first and second layers of fire-resistant material selected from the group consisting of a barrier sheet, a high loft batt, and a fire-resistant chemical. The cushioning layer is disposed between the first and second layers of fire-resistant material.

In a second aspect, a mattress includes an outer layer, a combustible cushioning material having a top surface and a bottom surface each treated with a fire-resistant material to form a fire-containing compartment, and an inner support compartment. The fire-containing compartment is interposed between the outer layer and the inner support compartment.

In a third aspect, a mattress includes a combustible layer having a top surface and a bottom surface and an inner support compartment. A fire-resistant material is disposed on the top surface and the bottom surface of the combustible layer to form a fire-containing compartment.

DETAILED DESCRIPTION OF THE INVENTION

FIGS. 2-7 show the invention which is directed to a fire-resistant mattress 10 that uses layers of fire-resistant material 14, 18 to compartmentalize material 16 within the mattress 10 so as to delay and possibly prevent the mattress 10 from becoming fully engulfed in flames as the result of the mattress 10 catching on fire.

Figure 1:
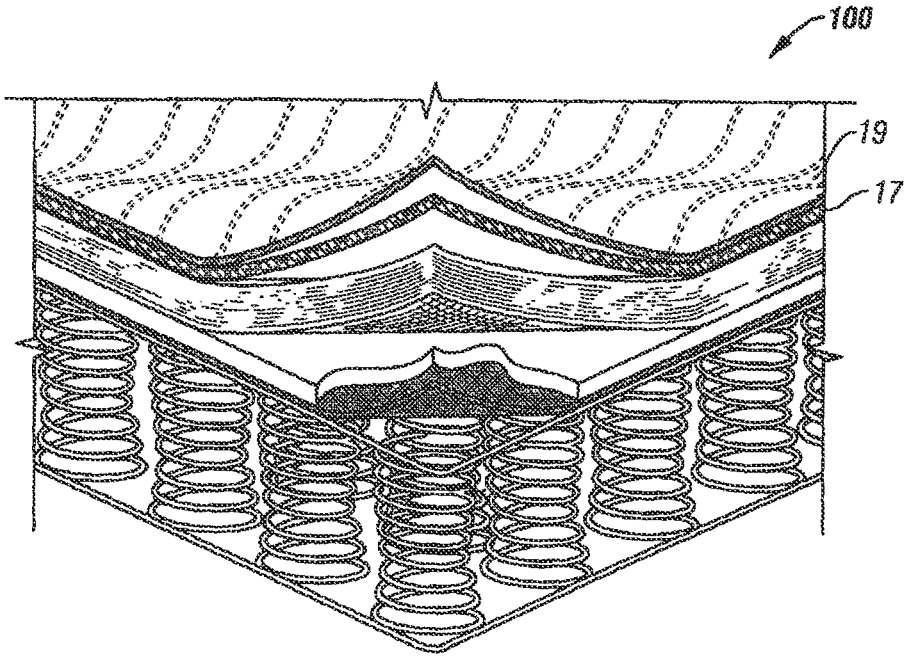
FIG. 1 (PRIOR ART)
FIG. 1 is a perspective, cut away view of a portion of a mattress constructed in accordance with the prior art.

As shown in FIG. 1, conventional fire-resistant or fire-retardant mattresses 100 include a single fire-resistant layer of material 17. This fire-resistant layer 17 is located near, if not directly beneath, the outer layer 19 of the mattress 100. In the event of a mattress fire caused, for example, by the bedding (not shown) on top of the mattress 100 catching on fire, the flame burns through the combustible outer layer of quilt or ticking 19. Although the fire-resistant layer 17 works most of the time, should the flame breach (i.e., burn through) the layer 17, there is no additional protection or barrier to prevent the fire from rapidly spreading through the rest of the mattress 100, thereby resulting in a high rate of combustion of the mattress 100. In still another embodiment of the prior art the outer layer 19 may itself be fire resistant. This eliminates the need for a second fire resistant layer such as 17 in FIG. 1.

For purposes of this invention, flashover is that point in time where the articles burning in a room generate enough energy to cause all room ingredients to burn essentially simultaneously. This point is normally accepted to be about 1,000 kW in a regular sized bedroom. Furthermore, for the purposes of this invention, the terms fire resistant and fire retardant are used interchangeably.

Figure 2:
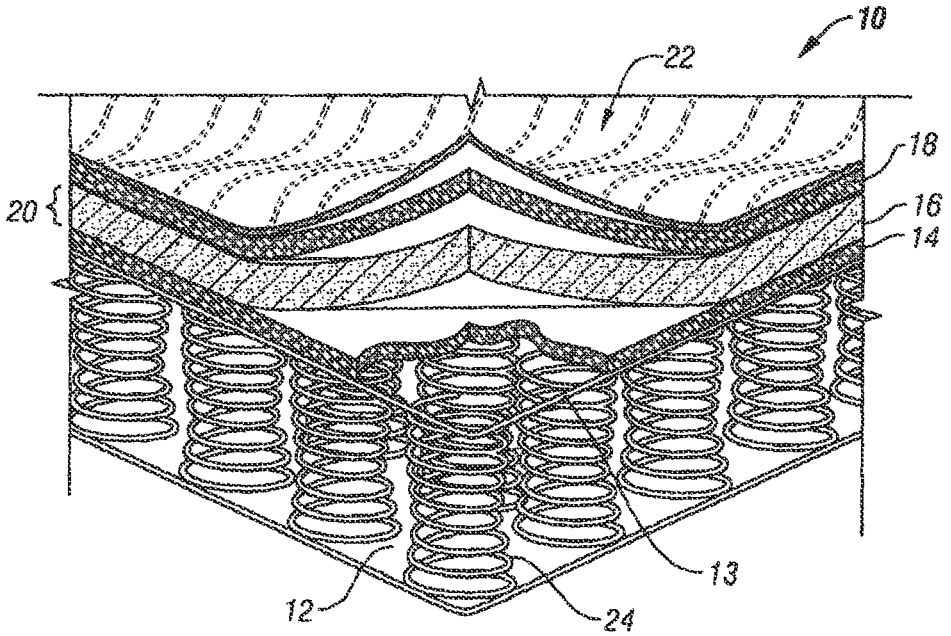
FIG. 2 is a perspective, cut away view of a portion of one embodiment of a mattress made in accordance with the principles of the present invention.

FIG. 2 shows one embodiment of the invention in which the fire-resistant mattress 10 is comprised of an inner support compartment 12, a first layer of fire-resistant material 14 adjacent to at least one side 13 of the inner support compartment 12, at least one layer of material 16 adjacent to the first layer of fire-resistant material 14, and a second layer of fire-resistant material 18 adjacent to the at least one layer 16, the second layer of fire-resistant material 18 being distal to the first layer of fire-resistant material 14. This use of fire-resistant layers of material 14, 18 on each side of the layer 16 creates a compartment 20 that helps to contain the fire from spreading throughout the mattress 10 should one of the fire-resistant layers 14, 18 be breached.

The at least one layer of material 16 that is compartmentalized between the fire-resistant layers 14, 18 can be a combustible material as well as a cushioning material. Furthermore, the layer of material 16 may be combustible material that has been treated with a fire-resistant chemical.

The compartmentalization of the material 16 results in fire-resistant integrity for the mattress 10 in much the same way that watertight doors provide watertight integrity in the event of flooding in a ship. That is, by containing the flooding within a specific compartment, the complete flooding of the ship is prevented, thereby increasing the chances of saving the entire ship. In the inventive mattress 10, fire is contained within the compartment 20 between the fire-resistant layers 14, 18 even in the event of the fire breaching one of the layers.

As shown in FIG. 2, the use of a first fire-resistant layer of material 14 located further inboard of the outer layer 22 of the inventive mattress 10 and closer to the inner support compartment 12 than the second fire-resistant layer 18, provides an additional layer of fire protection, thereby slowing the advance of the fire and allowing additional time for an individual to escape the room or building in which the mattress is located.

Figure 3:
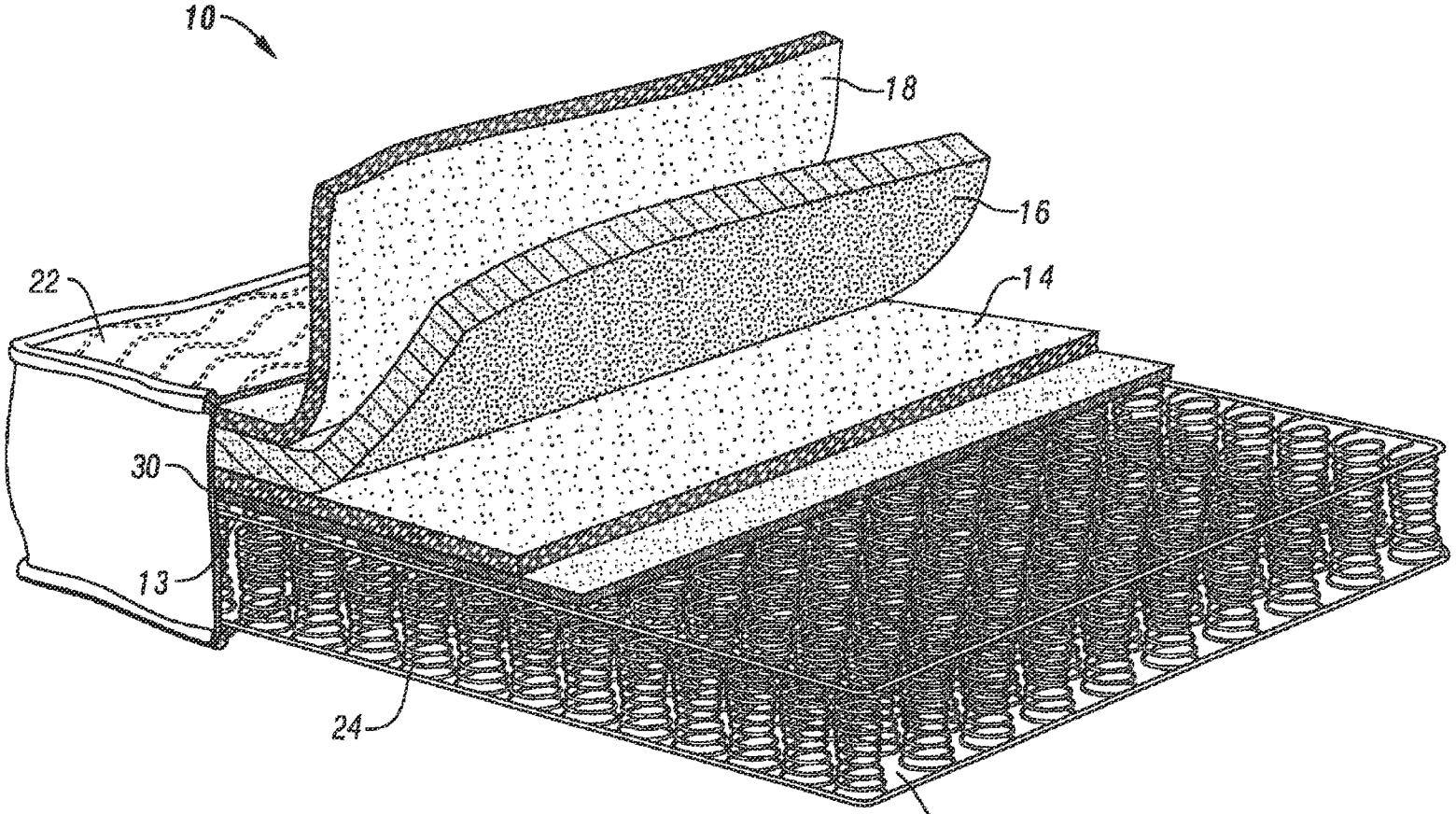
FIG. 3 is a perspective, cut away view showing a top portion of a mattress constructed in accordance with the principles of the invention.
Figure 4:
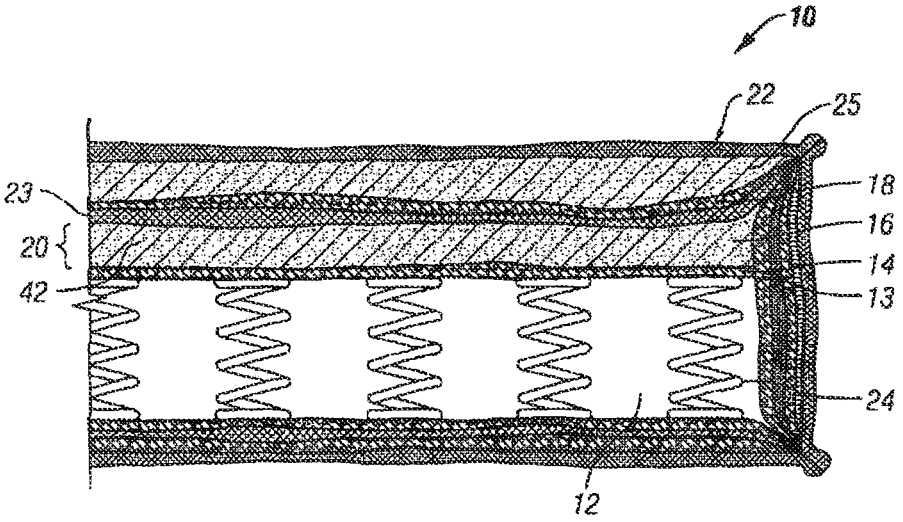
FIG. 4 is a sectional view of one embodiment of a single-sided mattress made in accordance with the principles of the invention.

FIGS. 2, 3, 4, 6 and 8 show one embodiment of the inventive mattress 10 in which at least one layer of material 16 is located between a first and second layer of fire-resistant material 14, 18 that are positioned on one side 13 of the inner support compartment 12. This type of mattress 10 is known as a single-sided mattress, as the top side of the inner support compartment 12 is built up with thicker upholstery material than the bottom or second side. In such a single-sided mattress, the side of inner support compartment 12 opposite of the sleeping side may be covered with one or more upholstery layers; however, it is not designed to be a sleeping surface. Of course, additional layers of materials 23, such as foam, quilt, and upholstery topper layers may be included between the layers of fire-resistant material 14, 18, as shown in FIG. 4, without departing from the scope and spirit of the invention.

Figure 5:
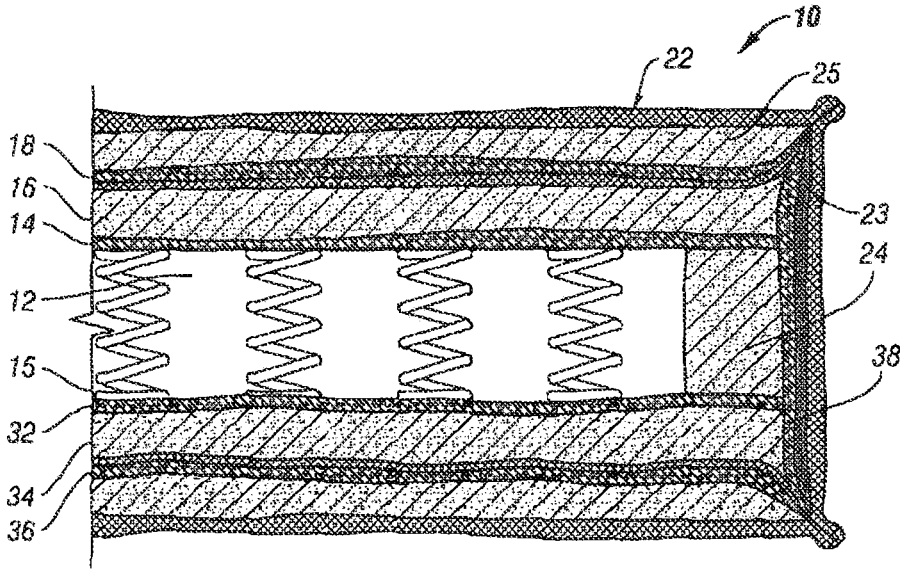
FIG. 5 is a sectional view of one embodiment of a double-sided mattress made in accordance with the principles of the invention showing the perimeter of the mattress protected with combustible material compartmentalized between two layers of fire-resistant material.
Figure 6:
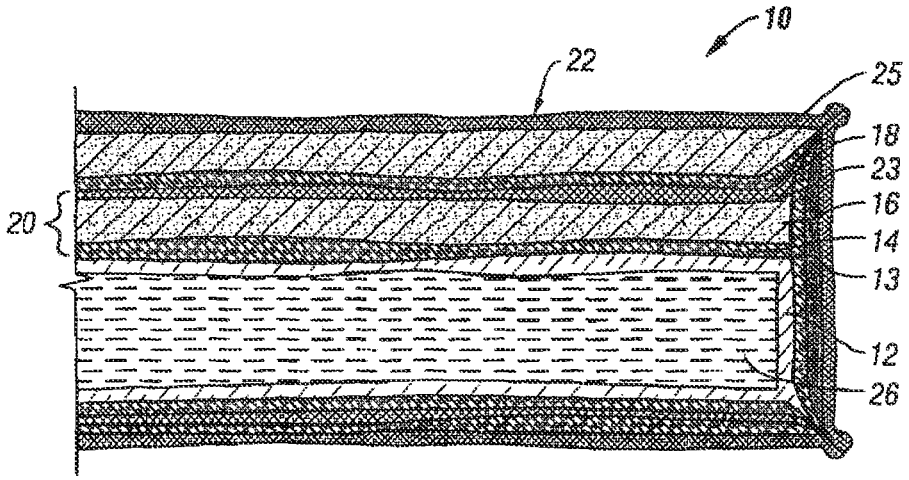
FIG. 6 is a sectional view of a single-sided embodiment of a mattress made in accordance with the principles of the invention showing the inner support compartment filled with foam.

When in use, should a fire start on the top of the mattress 10 shown in FIGS. 2-9, the flame will readily penetrate the outer layer of quilt or ticking 22, as well as any other sacrificial combustible material (e.g., 25 in FIGS. 4 and 6). Once the flame reaches the second layer of fire-resistant material 18, however, its rate of penetration will be slowed, if not completely stopped.

The layers of fire-resistant material 14, 18 used in the mattress 10 can be manufactured as a barrier sheet or a high loft batt. The layers 14, 18 may be made of blends of synthetic or natural fibers. Such fire-resistant layers 14, 18 are manufactured by several companies including, but not limited to, Basofil Fibers, LLC, Leggett & Platt, and Jones Fiber.

Should the second layer of fire-resistant material 18 be breached as a result of a tear in the fire-resistant layer, a flaw in the material, or any other reason, the fire will then spread through the layer(s) of material 16 immediately beneath the second fire-resistant layer 18. The fire will continue to advance in a controlled manner until it reaches the first layer of fire-resistant material 14 where it will once again be slowed, thereby delaying the involvement of the entire mattress 10.

This additional barrier of protection resulting from the first (i.e., inner) layer of fire-resistant material 14 helps contain the fire within the compartment 20 bordered by the two layers of fire-resistant material 14, 18. This compartmentalization of the fire slows or prevents the mattress 10 from being completely engulfed by fire, thereby increasing the length of time an occupant in the room or building housing the mattress has to flee to safety.

Although not 100% foolproof, the extra protection offered by the first (i.e., inner) layer of fire-resistant material 14 helps reduce the amount of heat generated by the fire, thereby allowing the mattress to burn for 30 minutes without exceeding 200 kW.

Figure 7:
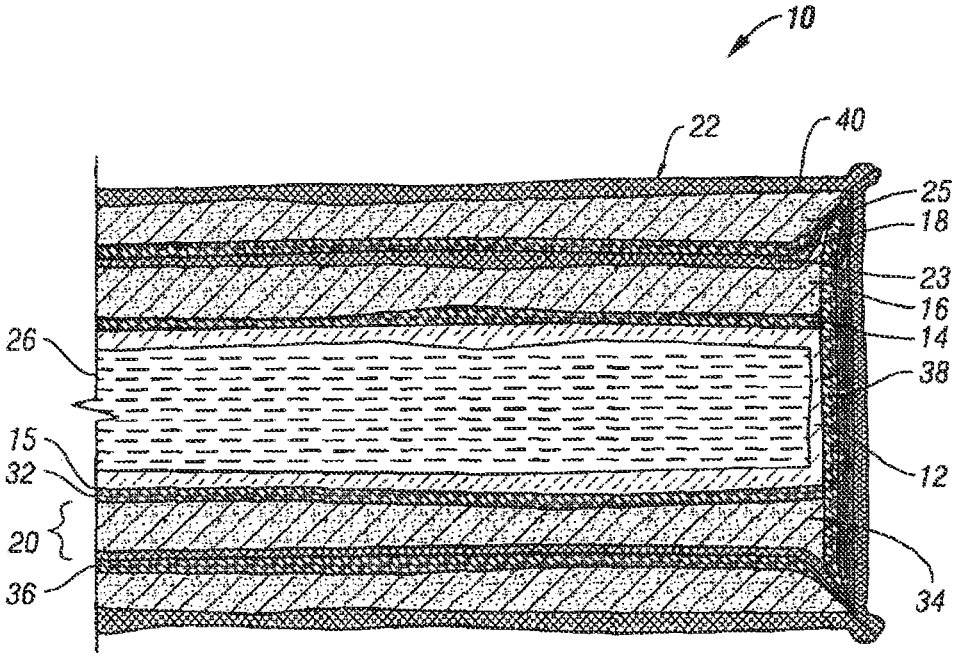
FIG. 7 is a sectional view of a double-sided embodiment of a mattress made in accordance with the principles of the invention showing the inner support compartment filled with foam and the perimeter two layers of fire-resistant material compartmentalizing the combustible material.

The inner support compartment 12 of the inventive mattress may be filled with any suitable material known in the art, including springs, air, water, foam or fiber. FIGS. 2-5, 8 and 9 show an inner support compartment 12 filled with springs 24, while FIGS. 6 and 7 show the compartment 12 filled with foam, fiber or other material 26. A layer of material 23 may also be located adjacent to the second layer of fire-resistant material 18 either distal or proximal to the at least one layer of cushioning material 16, as is shown in FIGS. 4-7. The cushioning material 16 may also be made of any suitable material, including foam and/or fiber.

In another embodiment of the invention, as shown in FIG. 3, at least one upholstery layer 30 is adjacent to the at least one side 13 of the inner support compartment 12 and the first layer of fire-resistant material 14 is adjacent to the at least one upholstery layer 30, but distal to the at least one side 13 of the inner support compartment 12. This allows for one or more layers of material 30 to be located between the inner support compartment 12 and the first layer of fire-resistant material 14. The inner support compartment 12 may also have a perimeter 11 that is surrounded by a layer of fire-retardant material 38, as shown in FIGS. 5 and 7.

In still another embodiment of the invention, as shown in FIGS. 5 and 7, the inner support compartment 12 has a second side 15 opposite the at least one side 13. A third layer of fire-resistant material 32 is located adjacent to the second side 15 of the inner support compartment 12, at least one layer of material 34 is adjacent to the third layer of fire-resistant material 32, and a fourth layer of fire-resistant material 36 is adjacent to the at least one layer of material 34 distal from the third layer of fire-resistant material 32. This type of mattress 10 is known as a double-sided mattress as cushioning material is located on both sides of the inner support compartment 12.

The compartmentalization of the at least one layer of material 34 on the second side 15 of the inner support compartment 12 works in the same way as does the compartmentalization on the first side 13. That is, the third and fourth layers of fire-resistant material 32, 36 act to contain any fire in the area between them, much in the same manner that two watertight doors contain flooding within a particular compartment on a ship. As with the single-sided mattress, the at least one layer of material 34 located between the third and fourth layers of fire-resistant material 32, 36 may be made of a combustible material and/or a cushioning material including, but not limited to, foam. The layer 34 may also be made of a combustible material that has been treated with a fire-resistant chemical.

Figure 8:
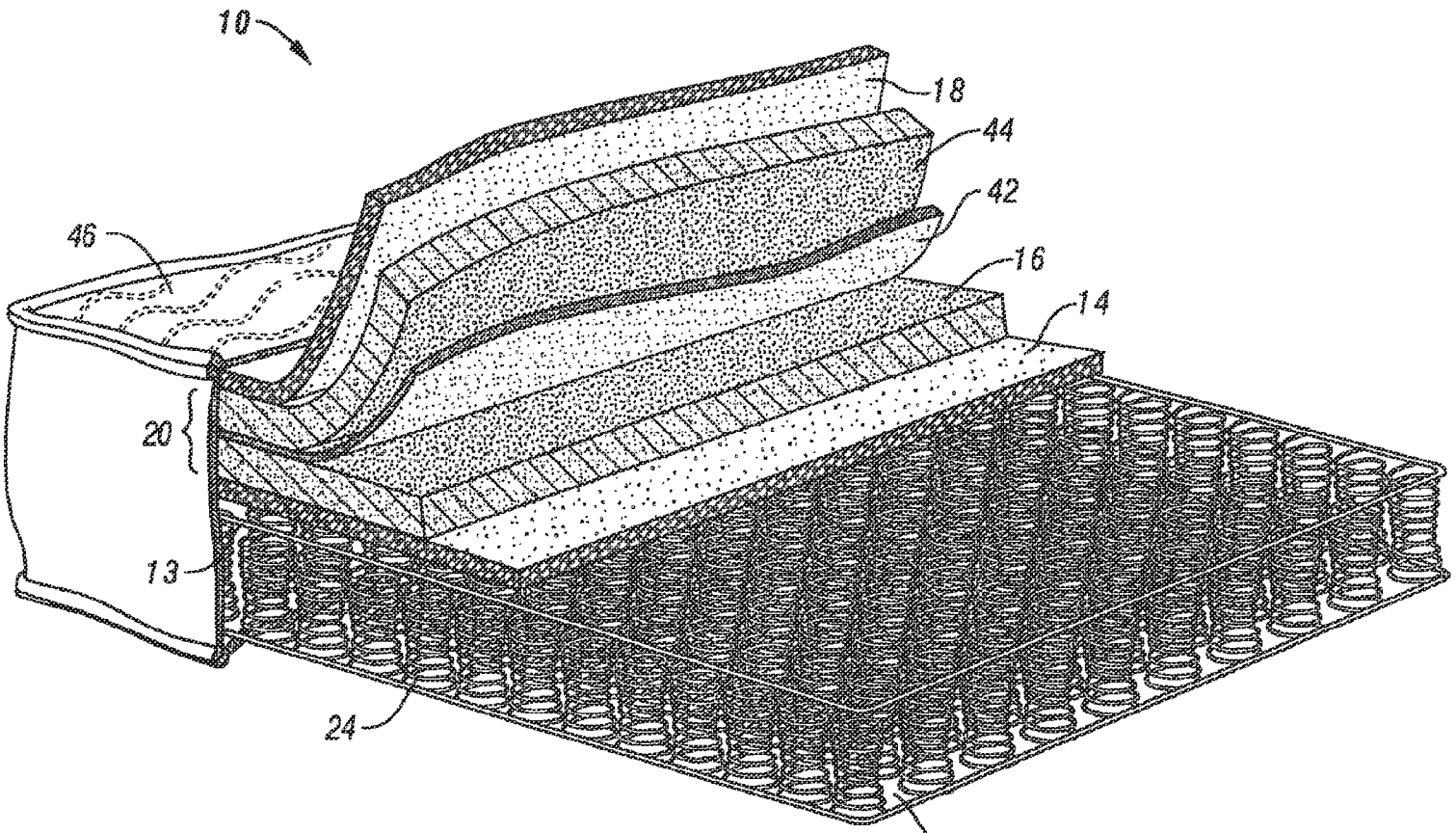
FIG. 8 is a perspective, cut away view showing a top portion of a mattress constructed in accordance with the invention, the mattress having a plurality of combustible layers of material between the two layers of fire-resistant material.

FIG. 8 shows still another embodiment of the invention wherein the mattress 10 has an inner support compartment 12, a fire-resistant insulation layer 14 having a first side and a second side positioned so that the first side is adjacent to at least one side of the inner support compartment 12, a first layer of material 16 is adjacent to the second side of the first fire-resistant layer 14, a quilt backing layer 42, having a first side and a second side, is positioned so that the first side of the quilt backing layer 42 is adjacent to the first layer of material 16, yet distal from the first fire-resistant layer 14, a second layer of material 44 is adjacent to the second side of the quilt backing layer 42, a second fire-resistant insulation layer 18 is located adjacent to the second layer of material 44 and distal from the quilt layer 42, and an outer layer 46, such as a ticking layer, is adjacent to the second fire-resistant layer 18. Again, this arrangement of building up the mattress using a first and second layer of fire-resistant material 14, 18 to establish a compartment 20 in which bedding material 16, 42, 44 is located helps reduce the fire growth of the mattress.

Figure 9:
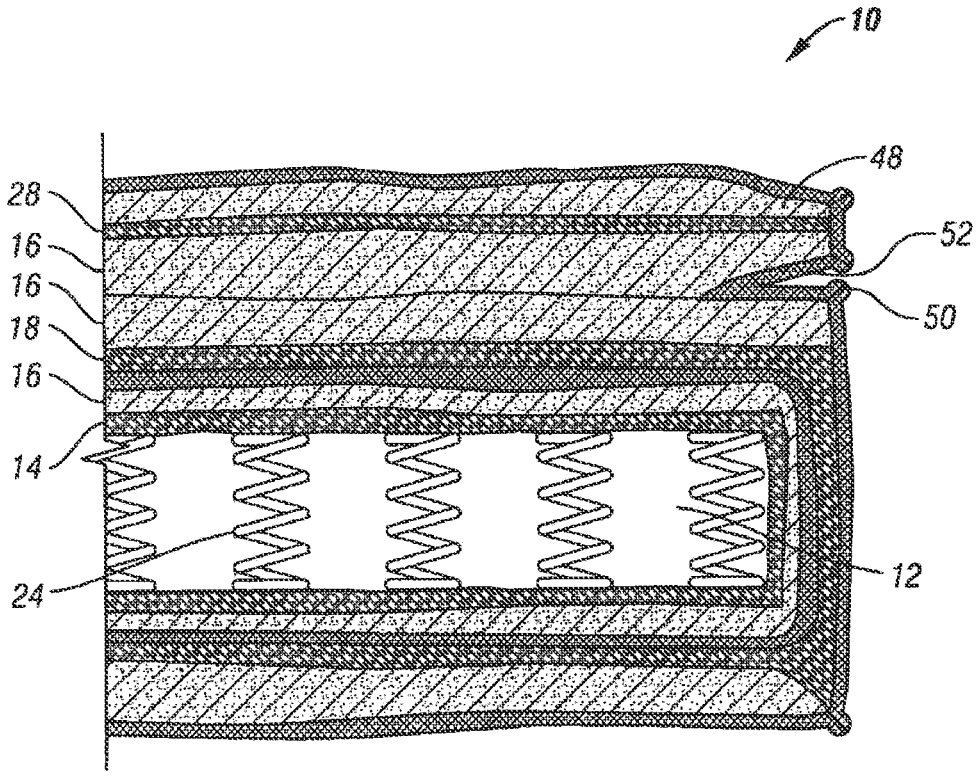
FIG. 9 is a sectional view of a pillow-top mattress.

FIG. 9 shows still another embodiment of the invention wherein the mattress 10 includes at least one additional layer of material 48 secured to a top layer 50 of the mattress 10. In this embodiment, known as a pillow-top or Euro-top mattress, the at least one additional layer of combustible material 48 is joined to the top layer 50 inboard of the perimeter of the mattress 10. This creates a void or "smile" 52 between the top layer 50 of the mattress 10 and the at least one additional layer 48. An additional layer of fire-resistant material 28 extends along the length of the mattress 10 adjacent to the at least one additional layer 48. At least one layer of material 16 is located next to the additional layer of fire-resistant material 28, proximal to the inner support compartment 12. A first layer of fire-resistant material 14 is located inboard of the at least one layer of combustible material 16 between the combustible material 16 and the inner support compartment 12, while a second layer of fire-resistant material 18 is located between the two layers of combustible material 16.

The invention also includes a method for manufacturing a fire-resistant mattress. This method of manufacturing involves the steps of: (a) providing an inner support compartment; (b) placing a first layer of fire-resistant material on a first side of the inner support compartment; (c) positioning at least one layer of combustible material adjacent to the first fire-resistant layer of material; (d) aligning a second layer of fire-resistant material on the at least one layer of combustible material distal to the first layer of fire-resistant material; and (e) placing a second layer of sacrificial combustible material outboard of the second layer of fire-resistant material distal to the inner support compartment. These materials may be independent or contained in a quilt.

All references, including publications, patent applications, and patents, cited herein are hereby incorporated by reference to the same extent as if each reference were individually and specifically indicated to be incorporated by reference and were set forth in its entirety herein.

The use of the terms "a" and "an" and "the" and similar referents in the context of describing the invention (especially in the context of the following claims) are to be construed to cover both the singular and the plural, unless otherwise indicated herein or clearly contradicted by context. Recitation of ranges of values herein are merely intended to serve as a shorthand method of referring individually to each separate value falling within the range, unless otherwise indicated herein, and each separate value is incorporated into the specification as if it were individually recited herein. All methods described herein can be performed in any suitable order unless otherwise indicated herein or otherwise clearly contradicted by context. The use of any and all examples, or exemplary language (e.g., "such as") provided herein, is intended merely to better illuminate the invention and does not pose a limitation on the scope of the invention unless otherwise claimed. No language in the specification should be construed as indicating any non-claimed element as essential of the practice of the invention.

Preferred embodiments of this invention are described herein, including the best mode known to the inventors for carrying out the invention. It should be understood that the illustrated embodiments are exemplary only, and should not be taken as limiting the scope of the invention.

What is claimed is:

1. A mattress, comprising:

a sleeping side;

a cushioning layer;

an inner support compartment; and a fire-containing compartment disposed between the sleeping side and the inner support compartment and having first and second layers of fire-resistant material selected from the group consisting of a barrier sheet, a high loft batt, and a fire-resistant chemical, wherein the cushioning layer is disposed between the first and second layers of fire-resistant material.

2. The mattress of claim 1, wherein the cushioning layer comprises a combustible material.

3. The mattress of claim 2, wherein the combustible layer comprises foam, fiber, a quilt material, upholstery, or combinations thereof.

4. The mattress of claim 1, wherein the inner support compartment comprises a spring, air, water, foam, or fiber.

5. The mattress of claim 1, wherein the fire-resistant material is selected from the group consisting of a barrier sheet and a high loft batt.

6. The mattress of claim 1, wherein the fire-resistant material is a fire-resistant chemical.

7. The mattress of claim 1, wherein the fire-containing compartment is configured to compartmentalize a fire started on the mattress to prolong the mattress from being completely engulfed by a fire.

8. The mattress of claim 1, wherein the mattress is a single-sided mattress.

9. The mattress of claim 8 further comprising a pillow-top disposed on a top layer of the mattress.

10. The mattress of claim 9, wherein the pillow-top comprises a sleeping surface disposed on a layer of cushioning material.

11. The mattress of claim 10, wherein the pillow-top creates a smile between the top layer of the mattress and the layer of cushioning material.

12. The mattress of claim 1, wherein the fire-resistant material disposed on the bottom surface of the cushioning layer is disposed between the cushioning layer and the inner support compartment.

13. The mattress of claim 12 further comprising a layer of upholstery material disposed on the fire-resistant material on the top surface of the cushioning layer.

14. A mattress, comprising:

an outer layer;

a combustible cushioning material having a top surface and a bottom surface each treated with a fire-resistant material to form a fire-containing compartment; and an inner support compartment, wherein the fire-containing compartment is interposed between the outer layer and the inner support compartment.

15. The mattress of claim 14, wherein the outer layer comprises a quilt or ticking layer.

16. The mattress of claim 14, wherein the combustible cushioning material comprises at least one of foam or fiber.

17. The mattress of claim 14, wherein the inner support compartment is filled with a material selected from the group consisting of springs, air, water, fiber and foam.

18. The mattress of claim 14, wherein at least one of the inner support compartment and the fire-containing compartment comprises a fire-resistant material extending around a perimeter thereof.

19. A mattress, comprising:

a combustible layer having a top surface and a bottom surface; and an inner support compartment, wherein a fire-resistant material is disposed on the top surface and the bottom surface of the combustible layer to form a fire-containing compartment.

20. The mattress of claim 19, wherein the combustible layer comprises a cushioning material.

* * * * *